US010463947B2

(12) United States Patent
Ara et al.

(10) Patent No.: US 10,463,947 B2
(45) Date of Patent: Nov. 5, 2019

(54) SNOWBOARD CONTROLLER

(71) Applicants: ARNAGE LIMITED CO., LTD., Kanagawa (JP); i-MAGIC. Inc., Kanagawa (JP)

(72) Inventors: Seiji Ara, Kanagawa (JP); Akihito Kawashima, Kanagawa (JP)

(73) Assignees: ARNAGE LIMITED CO., LTD., Kanagawa (JP); i-MAGIC, Inc., Kanagawa (JP)

( * ) Notice: Subject to any disclaimer, the term of this patent is extended or adjusted under 35 U.S.C. 154(b) by 74 days.

(21) Appl. No.: 15/900,584

(22) Filed: Feb. 20, 2018

(65) Prior Publication Data

US 2018/0178109 A1 Jun. 28, 2018

Related U.S. Application Data

(63) Continuation of application No. PCT/JP2016/088917, filed on Dec. 27, 2016.

(51) Int. Cl.
*A63C 10/14* (2012.01)
*A63C 10/28* (2012.01)

(52) U.S. Cl.
CPC ..... *A63C 10/28* (2013.01)

(58) Field of Classification Search
CPC ..... A63C 10/28; A63C 10/14; A63C 10/26; A63C 2203/20
See application file for complete search history.

(56) References Cited

U.S. PATENT DOCUMENTS 4,909,503 A * 3/1990 Olson ..... A63B 69/18 434/253
4,938,398 A * 7/1990 Hallsen ..... B60R 9/00 224/404
5,437,468 A 8/1995 Schenner
5,573,264 A 11/1996 Deville et al.
5,988,668 A 11/1999 DeVille et al.
6,634,657 B2 * 10/2003 Graham ..... A63C 5/16 280/14.27

(Continued)

FOREIGN PATENT DOCUMENTS

EP 2285457 B1 10/2012
JP H06-343734 A 12/1994

(Continued)

OTHER PUBLICATIONS

International Search Report issued in PCT/JP2016/088917 dated Mar. 21, 2017 (3 pages).

(Continued)

*Primary Examiner* — James A Shriver, II
*Assistant Examiner* — James J Triggs
(74) *Attorney, Agent, or Firm* — Nakanishi IP Associates, LLC

(57) ABSTRACT

A snowboard controller includes a base placeable on an upper surface of a board for a snowboard, a plurality of joints that join the base to the upper surface of the board. The plurality of joints include one joint being a direct joint at which the base is directly joinable to the board in a rotatable manner, and other joints being indirect joints at which the base is indirectly joinable to the board with joining members. The indirect joints control bending of the board using the direct joint as a base point.

10 Claims, 13 Drawing Sheets

(56) References Cited

U.S. PATENT DOCUMENTS

| | | | | |
|---|---|---|---|---|
| 6,767,313 | B2 * | 7/2004 | Sayce | A63B 69/18 482/146 |
| 2006/0217250 | A1 * | 9/2006 | Pearson | A63B 69/0093 482/146 |
| 2009/0105057 | A1 * | 4/2009 | Carlson | A63B 69/0066 482/146 |
| 2014/0336025 | A1 * | 11/2014 | Rafferty | A63B 21/4043 482/142 |

FOREIGN PATENT DOCUMENTS

| | | | |
|---|---|---|---|
| JP | H07-000587 | A | 1/1995 |
| JP | 2000-061022 | A | 2/2000 |
| JP | 2000-312735 | A | 11/2000 |
| JP | 2002-035198 | A | 2/2002 |
| JP | 2006-000460 | A | 1/2006 |
| JP | 2011-036513 | A | 2/2011 |
| JP | 2012-161488 | A | 8/2012 |

OTHER PUBLICATIONS

International Search Report issued in PCT/JP2016/088917 dated Mar. 21, 2017 with English Translation (5 pages).

* cited by examiner

SNOWBOARD CONTROLLER

CROSS-REFERENCE TO RELATED APPLICATIONS

The present application is a continuation application of International Patent Application No. PCT/JP2016/88917 filed on Dec. 27, 2016, the entire content of which is incorporated by reference.

BACKGROUND OF INVENTION

Field of the Invention

The present invention relates to a snowboard controller including a base arranged between a board and bindings for a snowboard, and joints that are joined to the board and the base to allow a predetermined movable range relative to the base to control bending of the board.

Background Art

A board for a snowboard is typically flexible and easily bends and deforms in accordance with the shape of the sliding slope surface, such as the snow surface, to have both mobility and shock absorption on the sliding slope surface.

In contrast, bindings and their fixtures are firmly fixed to the snowboard, and are highly rigid to receive an operational force applied by the snowboarder and directly transfer the received force to the board.

The bindings and their fixtures have such properties contradictory to the board. Thus, the bindings mounted onto the board with the fixtures in a conventional manner can reduce the flexibility of the board. This issue is also common to skis and bindings.

In response to this issue, ski bindings may be mounted onto the ski with a controller (platform) between them, instead of being directly mounted. One such platform for mounting ski bindings is described in Patent Literature 1.

The platform described in Patent Literature 1 includes an elastically deformable base plate (11), which is to be fixed on the upper surface of a ski (5), a front positioning plate (12) for positioning a front assembly of a ski binding, and a rear positioning plate (13) for positioning a rear assembly of the ski binding. The front positioning plate (12) is pivotally connected to the base plate (11) with a pair of front and rear levers, and supported on the upper surface of the base plate (11) at a predetermined front position. The rear positioning plate (13) is pivotally connected to the base plate (11) with a pair of front and rear levers, and supported on the upper surface of the base plate (11) at a predetermined rear position.

The platform described in Patent Literature 1 includes a plurality of joints that join the base plate (11) to the upper surface of the ski (5). All the joints join the base plate (11) to the ski (5) with levers in-between, which are joining members.

However, the platform described in Patent Literature 1 has its joining members that may be movable independently of one another within their movable ranges. This can degrade the connectedness between the user and the board (skis). The controller described in Patent Literature 1 can increase the difficulty in controlling the board, and is to be improved.

CITATION LIST

Patent Literature

Patent Literature 1: European Patent No. 2285457 (EP2285457 B1)

SUMMARY OF INVENTION

One or more aspects of the present invention are directed to a snowboard controller that increases controllability without reducing the flexibility of the snowboard.

One aspect of the invention provides a snowboard controller including a base placeable on an upper surface of a board for a snowboard, a front binding mount and a rear binding mount on each of which a binding is mountable, where the front binding mount and the rear binding mount are at a front position and a rear position of the base in a longitudinal direction of the base, and a plurality of joints that join the base to the upper surface of the board to allow a predetermined movable range to control bending of the board. The plurality of joints include a direct joint at which the base is directly joinable to the board in a rotatable manner, and an indirect joint at which the base is indirectly joinable to the board with a joining member. The plurality of joints include one joint being the direct joint, and other joints each being the indirect joint that controls bending of the board using the direct joint as a base point. The plurality of joints are arranged on at least one of a front end and a rear end of the base in the longitudinal direction and on a middle portion of the base in the longitudinal direction. The joint arranged on the at least one of the front end and the rear end of the base is the direct joint.

The above structure increases controllability without reducing the flexibility of the snowboard.

Further, the structure enables efficient control of the board to further increase the controllability of the board.

Another aspect of the invention provides a snowboard controller including a base placeable on an upper surface of a board for a snowboard, a front binding mount and a rear binding mount on each of which a binding is mountable, where the front binding mount and the rear binding mount are at a front position and a rear position of the base in a longitudinal direction of the base, and a plurality of joints that join the base to the upper surface of the board to allow a predetermined movable range to control bending of the board. The plurality of joints include a direct joint at which the base is directly joinable to the board in a rotatable manner, and at least one indirect joint at which the base is indirectly joinable to the board with a joining member. The plurality of joints include one joint being the direct joint, and other joints each being the indirect joint that controls bending of the board using the direct joint as a base point. At least one of the indirect joints includes a stretchable joining member that is stretchable in a longitudinal direction of the indirect joints, a stretch-resistance providing unit that provides stretch resistance in the stretchable joining member to control bending of the board, and a stretch-resistance adjusting unit that adjusts a magnitude of the stretch resistance provided by the stretch-resistance providing unit in the stretchable joining member.

In the above structure, the indirect joint includes the stretchable joining member including the stretch-resistance providing unit. The stretchable joining member absorbs shocks during sliding with the stretch-resistance providing unit to enhance the shock absorption.

The board bending and deforming during sliding receives the stretch resistance generated by the stretch-resistance providing unit, and thus easily restores its original shape for sliding on subsequent sliding slope surfaces. The board can bend and deform to closely follow rugged sliding slope surfaces, thus providing better controllability.

The stretch-resistance providing unit may be an elastic member, such as a spring and a rubber member, or a damper, or may include both the elastic member and the damper.

Further, the above structure includes the stretch resistance adjusting unit that adjusts the magnitude of stretch resistance in the stretchable joining member in accordance with the shape of the sliding slope surface, sliding conditions, or the ability and the skill level of each snowboarder (user), and increases the controllability of the board further.

Still another aspect of the invention provides a snowboard controller including a base placeable on an upper surface of a board for a snowboard, a front binding mount and a rear binding mount on each of which a binding is mountable, where the front binding mount and the rear binding mount are at a front position and a rear position of the base in a longitudinal direction of the base, and a plurality of joints that join the base to the upper surface of the board to allow a predetermined movable range to control bending of the board. The plurality of joints include a direct joint at which the base is directly joinable to the board in a rotatable manner, and an indirect joint at which the base is indirectly joinable to the board with a joining member. The plurality of joints include one joint being the direct joint, and other joints each being the indirect joint that controls bending of the board using the direct joint as a base point. The snowboard controller further includes a pair of control units each including the base and the plurality of joints. The pair of control units are placeable on the upper surface of the board in parallel in a width direction.

The above structure includes the pair of control units that are arranged in parallel in the width direction on the upper surface of the board, and thus controls the bending of the board at both sides of the board in the width direction. This increases stability and controllability.

The controller according to the above aspect may further include a torsion control unit that extends in the longitudinal direction of the base between the bases included in the pair of control units in a width direction of the bases.

The above structure includes a torsion control unit extending in the longitudinal direction. The torsion control unit is used as an axis about which torsion can be controlled during sliding. This structure thus enables smooth sliding at turns.

The controller according to the above aspect may further include base joining members arranged between the pair of control units in the width direction. The base joining members join the bases included in the pair of control units in the width direction. The base joining members are the front binding mount and the rear binding mount arranged at the front position and the rear position in the longitudinal direction of the base.

The above structure includes the binding mounts, which are the base joining members, arranged between the pair of control units in the width direction. The pair of control units each support the weight of the user in a balanced manner through the binding mounts. In addition, the binding mounts also join the pair of control units. This structure eliminates any additional joining member for joining the pair of control units, and thus reduces the number of components.

The snowboard controller according to the above aspects increases controllability without reducing the flexibility of the snowboard.

DETAILED DESCRIPTION

First Embodiment

One embodiment of the present invention will now be described with reference to the drawings.

Figure 1:
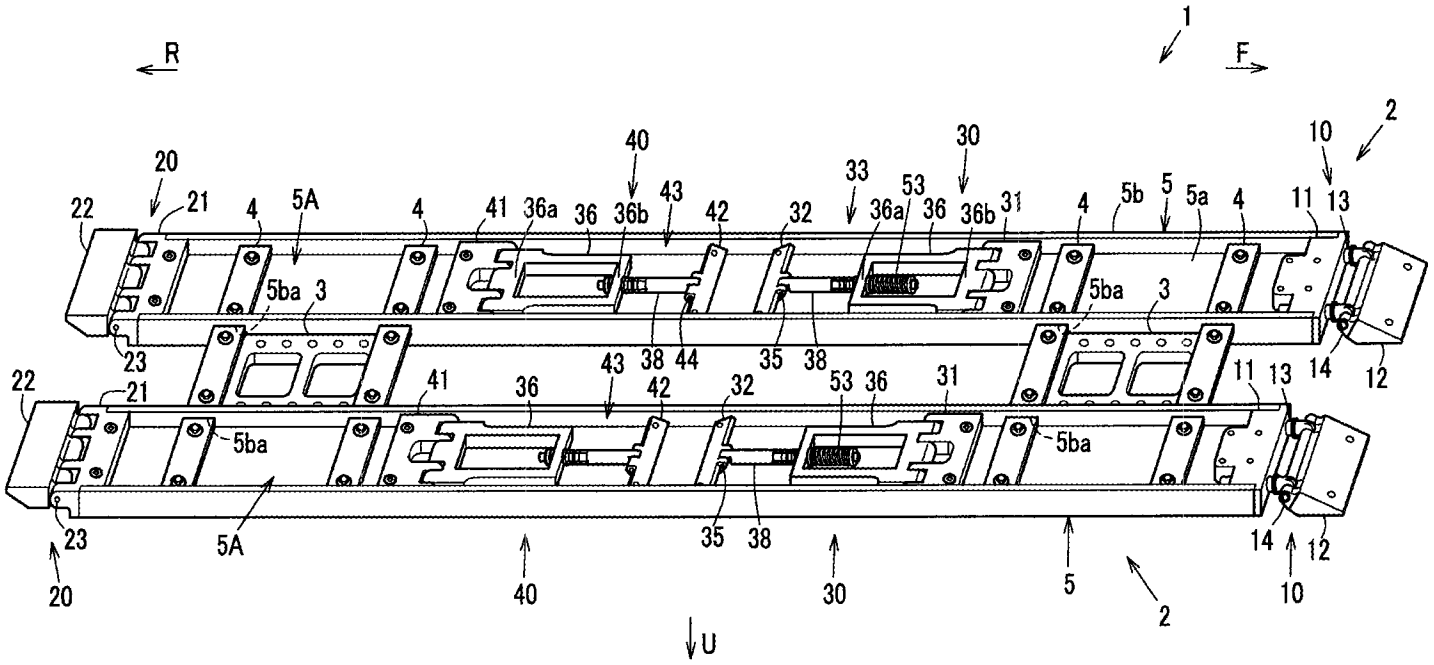
FIG. 1 is a perspective view of a snowboard controller in accordance with one embodiment as viewed from below.
Figure 2:
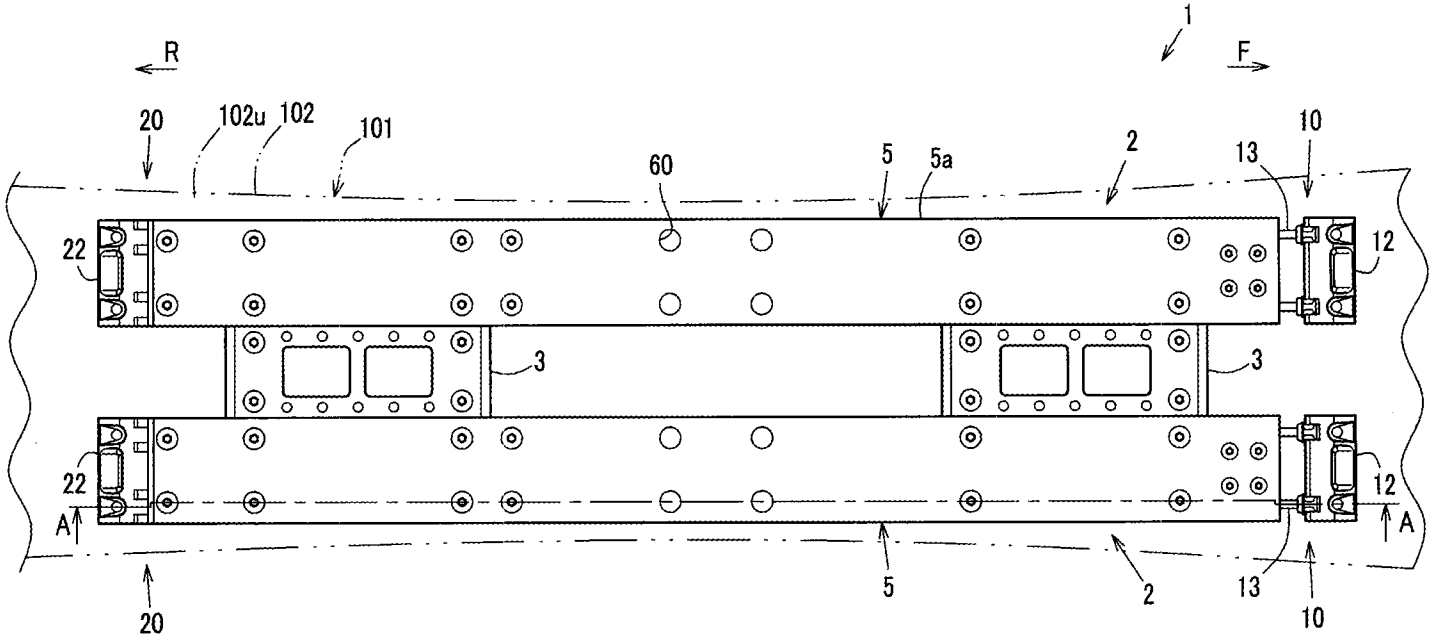
FIG. 2 is a plan view of the snowboard controller according to the embodiment.
Figure 3:
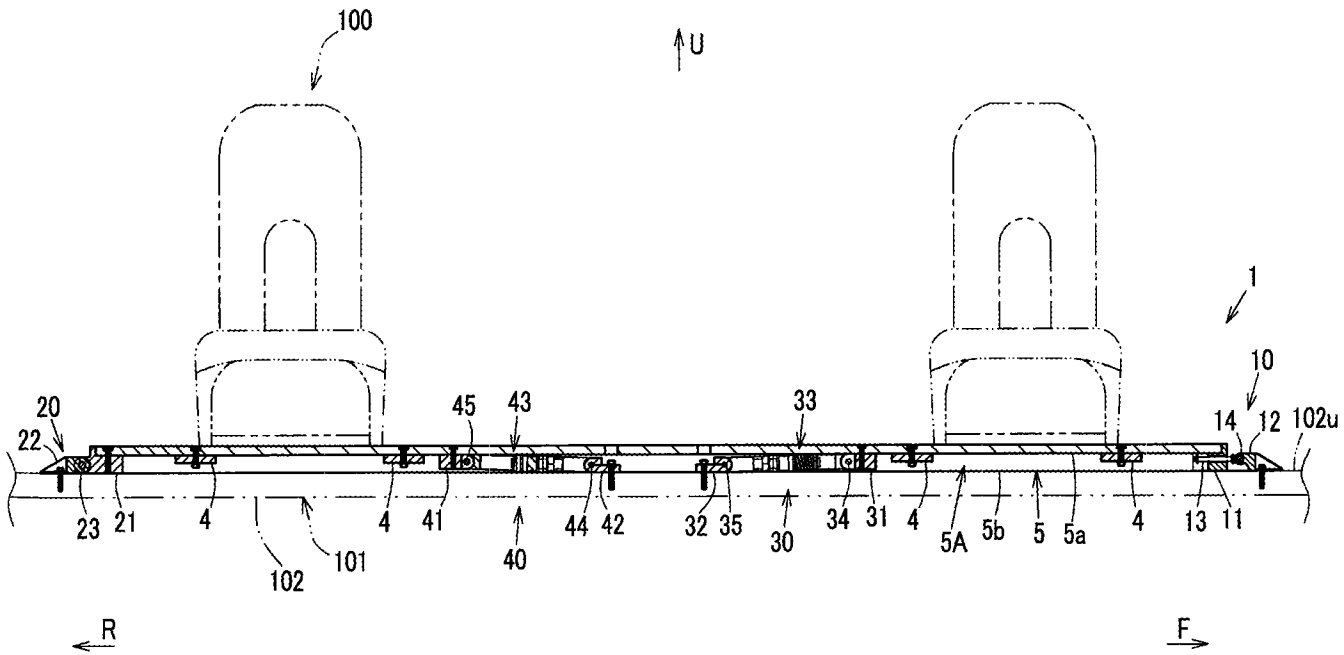
FIG. 3 is a longitudinal cross-sectional view taken along line A-A of FIG. 2.
Figure 4:
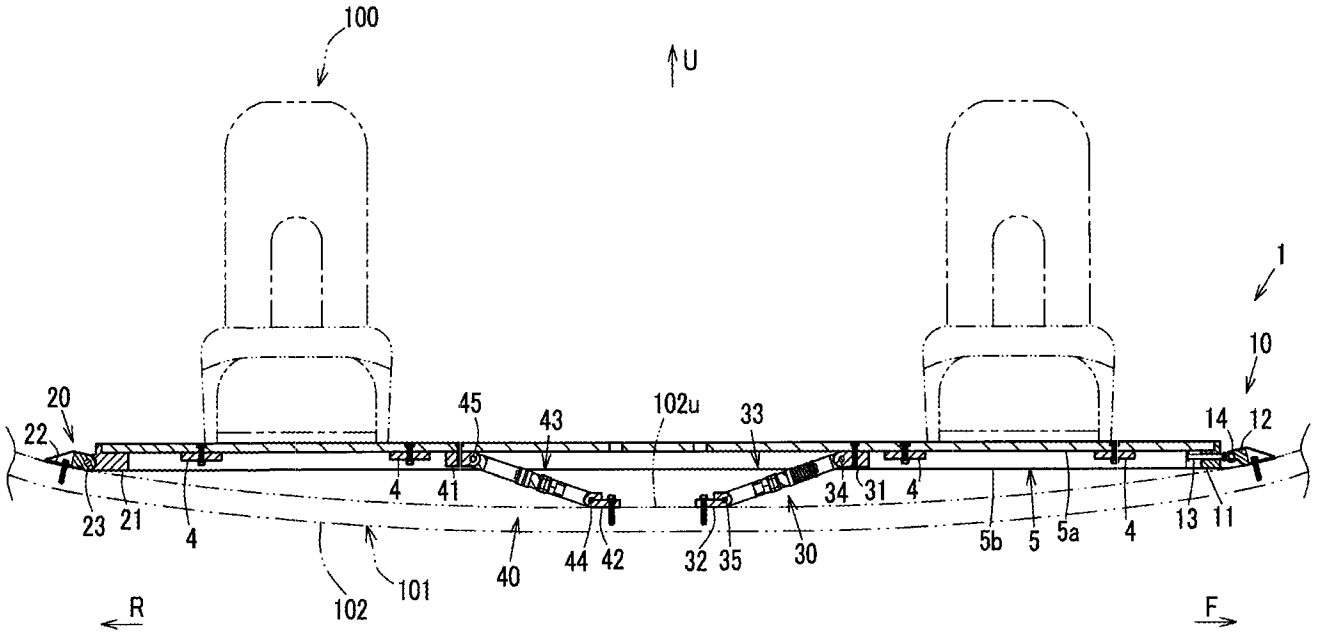
FIG. 4 is a diagram describing the operation of the snowboard controller according to the embodiment, corresponding to FIG. 3.
Figure 5:
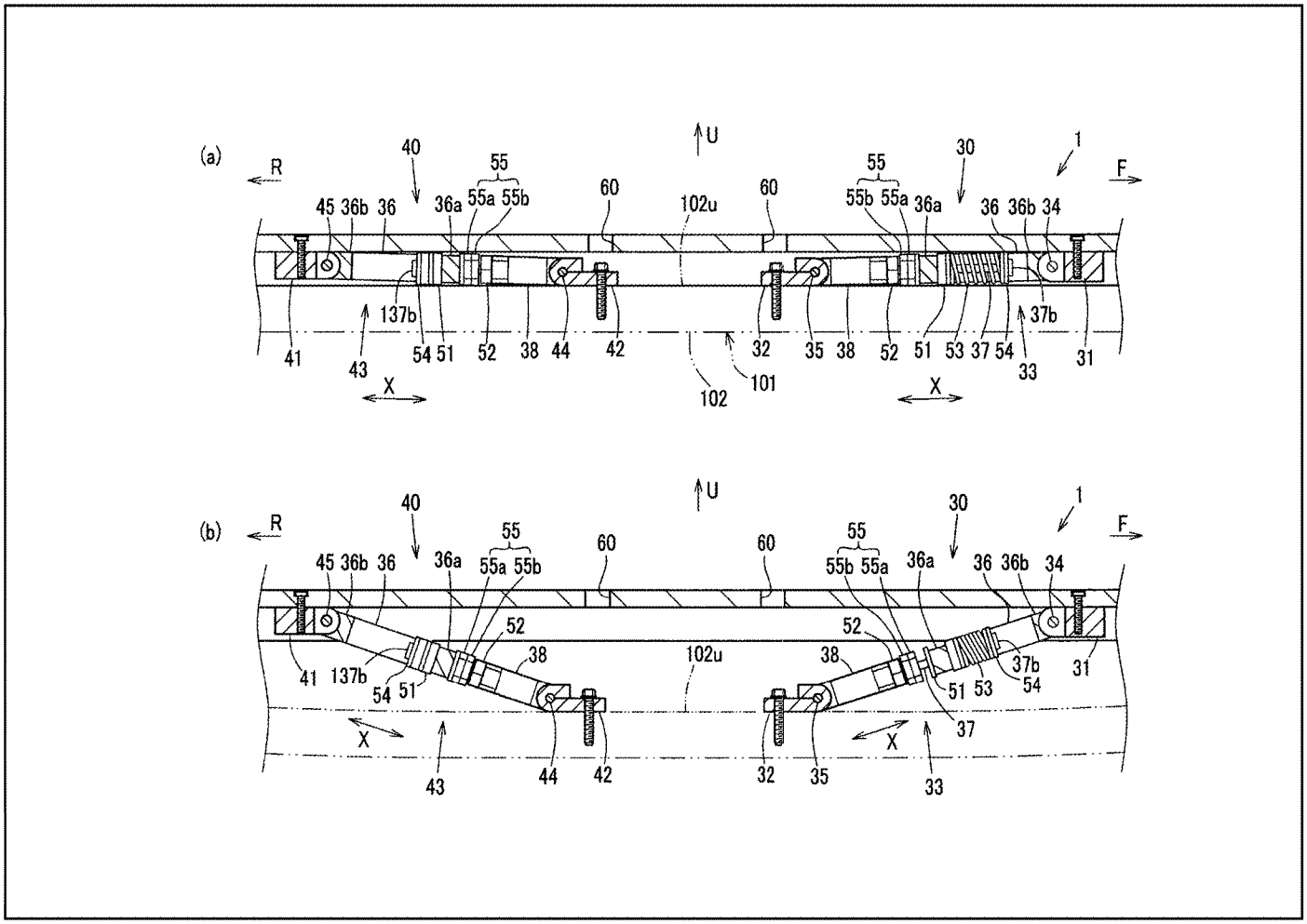
FIG. 5 is an enlarged view of a middle portion of the snowboard controller in a longitudinal direction for describing the structure and operation.
Figure 6:
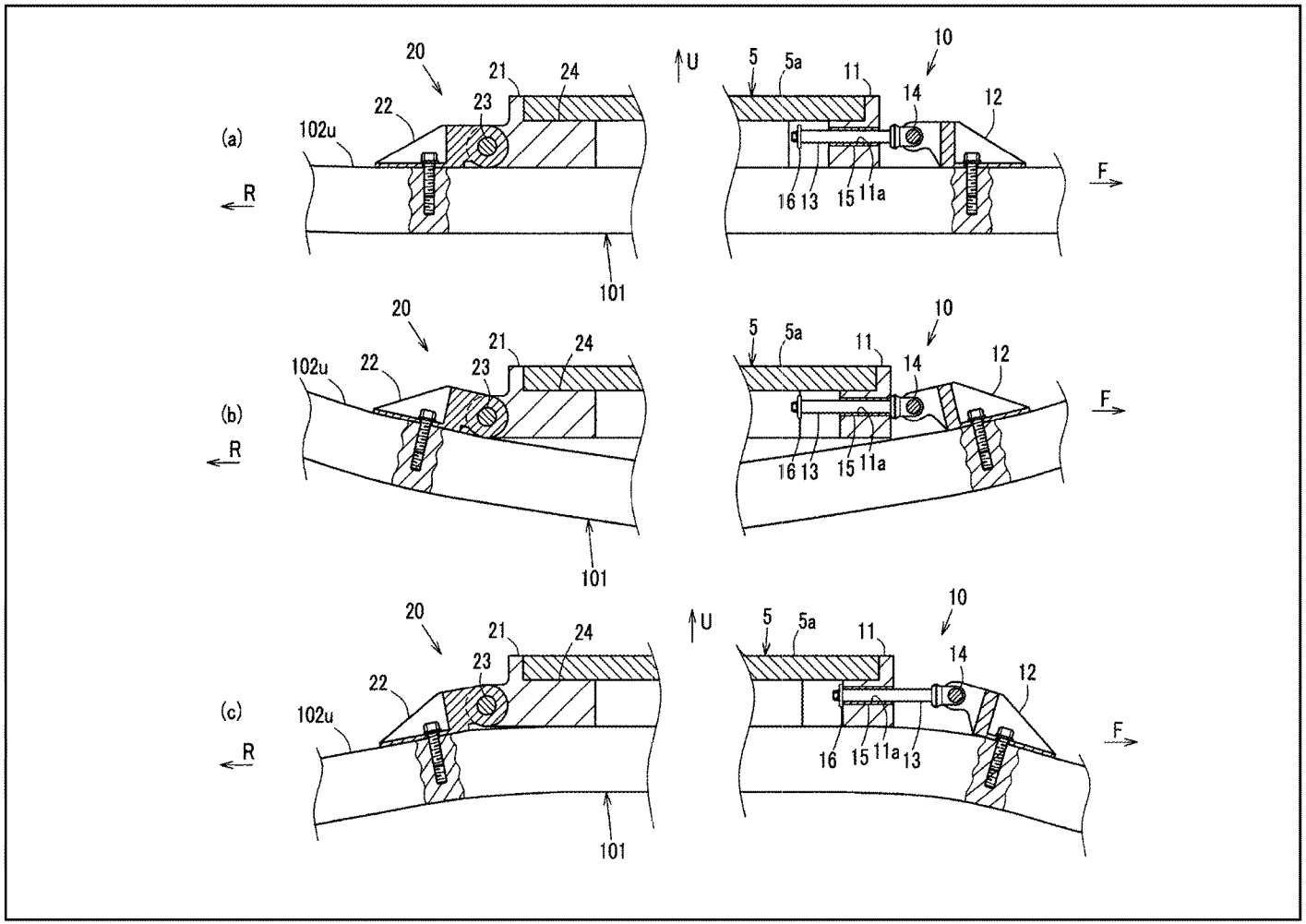
FIG. 6 is an enlarged view of both ends of the snowboard controller in the longitudinal direction for describing the structure and operation.
Figure 7:
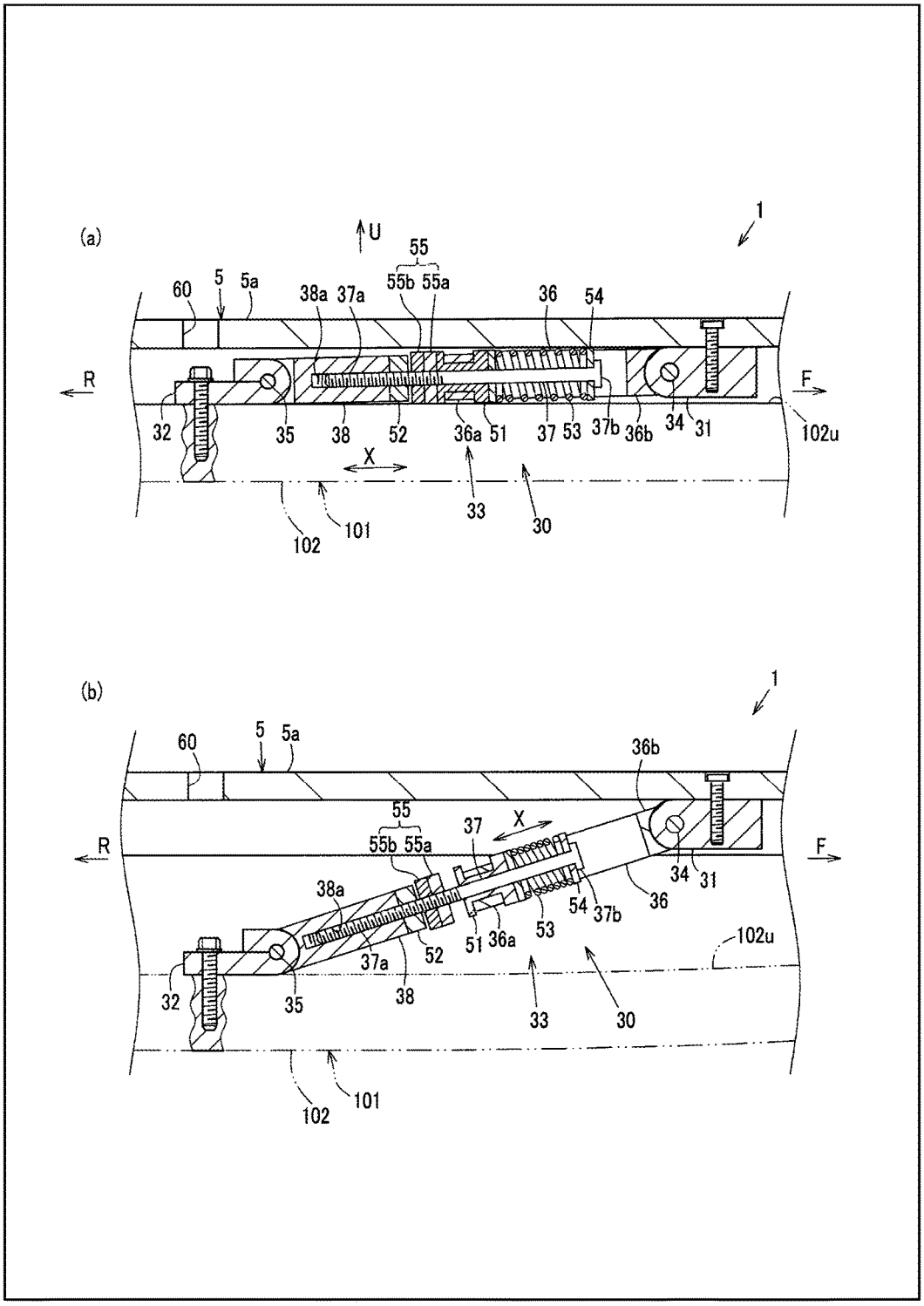
FIG. 7 is a longitudinal cross-sectional view of a front-middle joint at a middle position in a width direction for describing the structure and operation.
Figure 8:
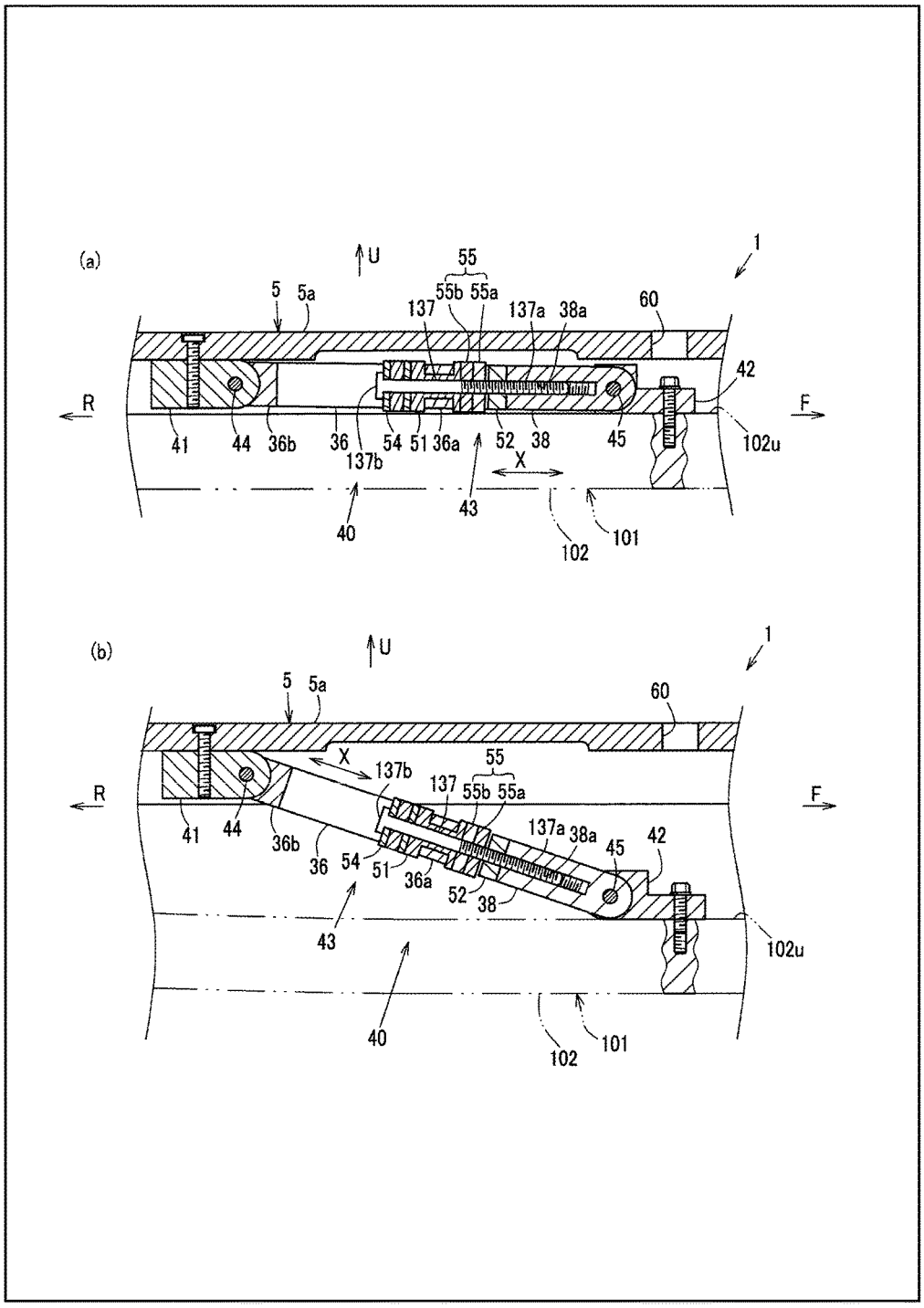
FIG. 8 is a longitudinal cross-sectional view of a rear-middle joint at a middle position in a width direction for describing the structure and operation.

FIG. 1 is a perspective view of a snowboard controller according to the present embodiment as viewed from below. FIG. 2 is a plan view of the snowboard controller according to the present embodiment mounted on a board. FIG. 3 is a longitudinal cross-sectional view taken along line A-A of FIG. 2. FIG. 4 is a diagram describing the operation of the snowboard controller according to the present embodiment, corresponding to FIG. 3. FIG. 5(*a*) is an enlarged view of a middle portion in a longitudinal direction in FIG. 3. FIG. 5(*b*) is an enlarged view of the middle portion in a longitudinal direction in FIG. 4. FIG. 6(*a*) is an enlarged view of both ends in the longitudinal direction in FIG. 3. FIG. 6(*b*) is an enlarged view of both ends in the longitudinal direction in FIG. 4. FIG. 6(*c*) is an enlarged view of both ends of the snowboard controller in the longitudinal direction, with the board bending in a direction opposite to the direction shown in FIG. 4. FIG. 7(*a*) is a longitudinal cross-sectional view of a front-middle joint at a middle position in a width direction for describing the operation of a front-middle stretchable arm. FIG. 7(*b*) is a longitudinal cross-sectional view corresponding to FIG. 7(*a*) for describing the operation of the front-middle stretchable arm inclined relative to the base. FIG. 8(*a*) is a longitudinal cross-sectional view of a rear-middle joint at a middle position in the width direction for describing the operation of a rear-middle arm. FIG. 8(*b*) is a longitudinal cross-sectional view corresponding to FIG. 8(*a*) for describing the operation of the rear-middle arm inclined relative to the base.

In the figures, an arrow F indicates the front of the controller, an arrow R indicates the rear of the controller, an arrow U indicates the upside of the controller, and an arrow X indicates an axial direction of the arm (described later).

As shown in FIGS. 1 to 4, a snowboard controller 1 (hereafter, a controller 1) according to a first embodiment includes a pair of control units 2, which are arranged in parallel in a width direction, binding mounting plates 3, which are arranged between the two control units 2 in the width direction to each allow a binding 100 (refer to FIG. 3) to be mountable, and joining plates 4.

The binding mounting plates 3 are arranged between the two control units 2 in the width direction. One binding mounting plate 3 is at a front position in a longitudinal direction (front to rear direction) of the control units 2, and the other binding mounting plate 3 is at a rear position in the longitudinal direction. The binding mounting plates 3 are integrally joined to the pair of control units 2 with joining plates 4.

More specifically, the joining plates 4 are strip-shaped and extend across the entire width of the controller 1. The joining plates 4 are arranged on the back of the controller 1 at positions corresponding to the front end and the rear end of each of the front binding mounting plate 3 and the rear binding mounting plate 3 in the longitudinal direction. The joining plates 4 bridge between the two control units 2 across the binding mounting plate 3. The joining plates 4 are fastened and fixed with bolts and nuts to the two control units 2 and to the binding mounting plate 3 at the overlapping portions as viewed from below. The two control units 2 are joined to each other integrally with the binding mounting plates 3 and the joining plates 4.

The two control units 2 have the same structure. The structure of one control unit 2 in the width direction will now be described.

The control unit 2 includes a base 5, which is arranged on an upper surface 102*u* of a board 102 included in a snowboard 101 (refer to FIGS. 2 and 3), and a plurality of joints 10, 20, 30, and 40, which join the base 5 to the upper surface 102*u* of the board 102 to allow a predetermined movable range of the board 102 relative to the base 5 to control bending of the board 102.

The base 5 includes a rectangular flat base plate 5*a*, which is longitudinally elongated as viewed from above, and side wall plates 5*b*, which are arranged at both ends in a width direction of the base plate 5*a* (refer to FIG. 1). The base plate 5*a* and the side wall plates 5*b* are integral with each other through molding using light and highly rigid carbon fibers. The side wall plates 5*b* extend downward from the lower surface of the base plate 5*a* and are joined to both ends of the base plate 5*a* in the width direction. In this structure, the side wall plates 5*b* are vertical walls extending across substantially the entire length of the base 5 in the longitudinal direction at both sides in the width direction of the base 5. The inner side wall plate 5*b* in the width direction of the base 5 has insertion holes 5*ba* (refer to FIG. 1), through which the joining plates 4 extend in the width direction.

As shown in FIGS. 1 and 3, the base 5 further includes a shallow accommodation space 5A in its bottom portion. The accommodation space 5A is defined by the lower surface of the base plate 5*a* and the inner surfaces of the side wall plates 5*b* at both sides in the width direction. The accommodation space 5A is open downward to accommodate at least parts of the joints 10, 20, 30, and 40.

The joints 10, 20, 30, and 40 include a front joint 10 arranged at the front end of the base 5 in the longitudinal direction (front to rear direction), a rear joint 20 arranged at the rear end, a front-middle joint 30 arranged in the middle and nearer the front end, and a rear-middle joint 40 arranged in the middle and nearer the rear end.

As shown in FIG. 6(*a*), the front joint 10 includes a front base mount 11, which is fastened to the front end of the base 5 with bolts or other connections, a front board mount 12, which is to be fastened to a portion of the upper surface 102*u* of the board that is not bent or deformed and facing the front board mount 12 with bolts or other connections, slide shafts 13, and a rotation shaft 14.

The front base mount 11 has through-holes 11*a* in the longitudinal direction on each of the two sides in its width direction. The through-holes 11*a* each allow a guide bush 15 to be fitted. Each slide shaft 13 is supported on the front base mount 11 with the guide bush 15 in a manner slidable in the longitudinal direction.

The rear end of the slide shaft 13 includes a flange stopper 16, which comes in contact with the rear surface of the front base mount 11 to prevent the slide shaft 13 from slipping off. The front end of the slide shaft 13 is joined to a rear portion of the front board mount 12 in a rotatable manner about the rotation shaft 14 extending in the width direction.

The front board mount 12 is slidable (extendable) in the longitudinal direction on the slide shafts 13 relative to the front base mount 11, and is rotatable about the rotation shaft 14 with the rotation shaft 14 extending in the width direction.

As described above, the front joint 10 includes the front board mount 12 that is joined to the front base mount 11 indirectly with the slide shafts 13 instead of being directly joined, and is rotatable about the rotation shaft 14.

As shown in FIG. 6(*a*), the rear joint 20 includes a rear base mount 21, which is fastened to the rear end of the base 5 with bolts or other connections, a rear board mount 22, which is to be fastened to a portion of the upper surface 102*u* of the board that is not bent or deformed and facing the rear board mount 22 with bolts or other connections, and a rotation shaft 23.

The rear portion of the rear base mount 21 is joined to the front portion of the rear board mount 22 in a rotatable manner about the rotation shaft 23 extending in the width direction.

As described above, the rear joint 20 includes the rear board mount 22 that is directly joined to the rear base mount 21 and is rotatable about the rotation shaft 23.

As shown in FIG. 5(*a, b*) and FIG. 7(*a, b*), the front-middle joint 30 includes a front-middle base mount 31 that is fastened to the base 5 at its middle front position with bolts or other connections, a front-middle board mount 32 that is to be fastened to a portion of the upper surface 102*u* of the board that is not bent or deformed and facing the front-middle board mount 32 with bolts or other connections, a front-middle stretchable arm 33, which is arranged between the front-middle base mount 31 and the front-middle board mount 32 in a stretchable manner, a base rotation shaft 34, and a board rotation shaft 35. FIG. 5(*a, b*) and FIG. 7(*a, b*) also show holes 60, each of which allows a tool to pass through it when the front-middle board mount 32 is bolted to the board 102.

The front-middle stretchable arm 33 includes a frame 36, which is substantially rectangular as viewed from below (refer to FIG. 1), a slide shaft 37, a cylindrical shaft receptacle 38, and a guide bush 51.

In detail, the slide shaft 37 is a bolt that is inserted through the guide bush 51 from the base 5 toward the board 102. The guide bush 51 is fit in a through-hole formed in a board side 36*a* of the frame 36 to extend in the axial direction of the arm. As shown in FIG. 7 (*a, b*), the slide shaft 37 includes a head 37*b* at an end nearer the base 5 and external threads 37*a* at a distal end protruding from the board side 36*a* of the frame 36 toward the board 102. The shank of the slide shaft 37 between the head 37*b* and the external threads 37*a* is cylindrical (or is a round rod) without having the external threads 37*a* on its peripheral surface.

The slide shaft 37 has its round rod portion without the external threads 37*a* (thread-free portion) inserted in the guide bush 51. This allows the slide shaft 37 to be slidably held in the guide bush 51 in the axial direction of the arm relative to the guide bush 51.

The front-middle stretchable arm 33 includes the cylindrical shaft receptacle 38 near the board 102. The cylindrical shaft receptacle 38 has one end nearer the board 102 closed and the other end nearer the base 5 open to have a tubular shape into which the slide shaft 37 is insertable. The cylindrical shaft receptacle 38 has, on its inner peripheral surface, internal threads 38*a* to be screwed with the external threads 37*a* of the slide shaft 37.

The tip end of the slide shaft 37 is inserted in the cylindrical shaft receptacle 38 to have the external threads 37*a* screwed with the internal threads 38*a*.

As shown in FIG. 5(*a, b*) and FIG. 7(*a, b*), the front-middle stretchable arm 33 further includes an arm length adjustment nut 52, which adjusts the stretch length of the front-middle stretchable arm 33 (slide length of the slide shaft 37). The arm length adjustment nut 52 is arranged between the cylindrical shaft receptacle 38 and the guide bush 51, and is screwed on the external threads 37*a* of the slide shaft 37.

The arm length adjustment nut 52 is rotated relative to the cylindrical shaft receptacle 38 to allow the slide shaft 37 to slide relative to the cylindrical shaft receptacle 38. This adjusts the length of the front-middle stretchable arm 33.

As shown in the same figures, the front-middle stretchable arm 33 further includes a coil spring 53, which is wound around the slide shaft 37 between the guide bush 51 and the head 37*b* of the slide shaft 37, a pressing plate 54, which presses the spring 53 from the base 5 toward the board 102 to hold the spring 53, and a double nut 55 (55*a*, 55*b*), which adjusts the stretch amount of the spring 53.

The pressing plate 54 is an annular plate (washer) arranged between the head 37*b* of the slide shaft 37 and the spring 53. The pressing plate 54 is integrally attached to the slide shaft 37 at a position to press the spring 53 toward the board side 36*a* of the frame 36 from an equilibrium length to a compressed state.

At its normal position, the slide shaft 37 is thus urged toward the base 5 in the axial direction of the arm.

The spring 53 is a stretch-resistance providing unit that provides stretch resistance in the front-middle stretchable arm 33. The spring 53 is arranged coaxially with the slide shaft 37. As the slide shaft 37 slides toward the board 102 relative to the guide bush 51, the spring 53 is, for example, further compressed and deformed to provide an elastic force (restoring force), or stretch resistance, to the slide shaft 37.

The double nut 55 is arranged between the arm length adjustment nut 52 and the guide bush 51, and is screwed on the external threads 37*a* of the slide shaft 37. The double nut 55 includes two nuts, or an elastic force adjusting nut 55*a* and a fixing nut 55*b*. The elastic force adjusting nut 55*a* adjusts the magnitude of the elastic force from the spring 53 by rotating about the slide shaft 37 to change the length of the spring 53. The fixing nut 55*b* fixes the elastic force adjusting nut 55*a* to prevent it from rotating. The elastic force adjusting nut 55*a* is arranged nearer the base 5, whereas the fixing nut 55*b* is arranged nearer the board 102.

As the slide shaft 37 slides in the axial direction of the arm relative to the guide bush 51 included in the board side 36*a* of the frame 36, the front-middle board mount 32, the cylindrical shaft receptacle 38, the arm length adjustment nut 52, the double nut 55, and the pressing plate 54 also slide together with the slide shaft 37.

As described above, when the front-middle stretchable arm 33 stretches toward the board 102 against the urging force (restoring force) from the spring 53, the spring 53 is further compressed to apply a greater urging force (restoring force) to the front-middle stretchable arm 33.

As described above, the slide shaft 37 at its normal position is urged toward the base 5 in the axial direction of the arm. At this position, the end surface of the elastic force adjusting nut 55*a* nearer the base 5 is in tight contact with the end surface of the guide bush 51 nearer the board 102 (refer to FIG. 7(*a*)). When the front-middle stretchable arm 33 stretches toward the board 102 against the urging force (restoring force) from the spring 53, the slide shaft 37 slides toward the board 102. This causes the end surface of the elastic force adjusting nut 55*a* nearer the base 5 to be spaced from the end surface of the guide bush 51 nearer the board 102 (refer to FIGS. 5(*b*) and 7(*b*)).

The front portion of the front-middle stretchable arm 33, or specifically a base side 36*b* of the frame 36, is joined to the rear portion of the front-middle base mount 31 in a rotatable manner about a base rotation shaft 34 extending in the width direction. The rear portion of the front-middle stretchable arm 33, or specifically the end of the cylindrical shaft receptacle 38 nearer the board 102, is joined to the front portion of the front-middle board mount 32 in a rotatable manner about the board rotation shaft 35 extending in the width direction.

As described above, the front-middle joint 30 includes the front-middle board mount 32 that is rotatable about the base rotation shaft 34 and the board rotation shaft 35 and is indirectly joined to the front-middle base mount 31 with the front-middle stretchable arm 33.

As shown in FIG. 5(*a, b*) and FIG. 8(*a, b*), the rear-middle joint 40 includes a rear-middle base mount 41, which is fastened to the base 5 at it is middle rear position with bolts or other connections, a rear-middle board mount 42, which is to be fastened to a portion of the upper surface 102*u* of the board that is not bent or deformed and facing the rear-middle board mount 42 with bolts or other connections, a rear-middle arm 43, which is arranged between the rear-middle base mount 41 and the rear-middle board mount 42, a base rotation shaft 44, and a board rotation shaft 45.

Similarly to the front-middle stretchable arm 33, the rear-middle arm 43 includes the frame 36 that is substantially rectangular as viewed from below, a slide shaft 137, the cylindrical shaft receptacle 38, the guide bush 51, the arm length adjustment nut 52, and the double nut 55. In the present embodiment, unlike the slide shaft 37 included in the front-middle stretchable arm 33, the slide shaft 137 included in the rear-middle arm 43 is a shorter bolt that does not allow sliding relative to the guide bush 51 in the axial direction of the arm. The rear-middle arm 43 in the present embodiment is thus not stretchable in the axial direction of the arm.

Although the slide shaft 137 in the rear-middle arm 43 has a shorter length than the slide shaft 37 in the front-middle stretchable arm 33, the slide shaft 137 has the same basic structure as the slide shaft 37. The cylindrical shaft receptacle 38, the guide bush 51, the arm length adjustment nut 52, and the double nut 55 included in the rear-middle arm 43 each have the same structure as the corresponding components of the front-middle stretchable arm 33, and will not be described in detail.

In the present embodiment, the rear-middle arm 43 eliminates the spring 53 between the guide bush 51 and the head 137*b* of the slide shaft 137, and thus includes no unit for providing resistance in the rear-middle arm 43 when it stretches.

The rear-middle arm 43 may have the same structure as the front-middle stretchable arm 33, or specifically may allow the slide shaft 137 to slide in the axial direction of the arm or may include the spring 53 to provide stretch resistance in the rear-middle arm 43 with its elastic force. In this modification, the rear-middle arm 43, which is unstretchable and thus cannot provide stretch resistance in the above embodiment, may simply be replaced with a separate part having the same structure as the front-middle stretchable arm 33 as appropriate. This easily allows the rear-middle arm 43 to function as a rear-middle stretchable arm (not shown).

The rear portion of the rear-middle arm 43, or specifically a base side 36*b* of the frame 36, is joined to the front portion of the rear-middle base mount 41 in a rotatable manner about a base rotation shaft 44 extending in the width direction. The front portion of the rear-middle arm 43, or specifically the end of the cylindrical shaft receptacle 38 nearer the board 102, is joined to the rear portion of the rear-middle board mount 42 in a rotatable manner about a board rotation shaft 45 extending in the width direction.

As described above, the rear-middle joint 40 includes the rear-middle board mount 42 that is rotatable about the base rotation shaft 44 and the board rotation shaft 45 and is indirectly joined to the rear-middle base mount 41 with the rear-middle arm 43.

The operation of the above controller 1 will now be described.

As shown in FIG. 6(*b*), when the board 102 deforms into an inverted arch with its longitudinal middle portion curved downward (refer to FIG. 4), the front board mount 12 included in the front joint 10 rotates relative to the front base mount 11 in a direction in which the front end of the front board mount 12 faces obliquely upward toward the front. When the board 102 further deforms into a more curved inverted arch, the slide shaft 13 in the front joint 10 slides to retract rearward.

When the board 102 deforms into an arch with its longitudinal middle portion protruding upward as shown in FIG. 6(*c*), the front board mount 12 included in the front joint 10 rotates relative to the front base mount 11 in a direction in which the front end of the front board mount 12 faces obliquely downward toward the front. When the board 102 further deforms into a more curved arch, the slide shaft 13 in the front joint 10 slides to protrude frontward.

As described above, the front joint 10 includes the front board mount 12 that rotates and slides in accordance with the degree of bending of the board 102. This enables the front joint 10 to deform to follow and allow the deformation of the board 102. The front joint 10 thus prevents the front end of the board 102 from bending excessively or flapping.

When the board 102 deforms into an inverted arch as shown in FIG. 6(*b*), the rear board mount 22 included in the rear joint 20 rotates relative to the rear base mount 21 in a direction in which the rear end of the rear board mount 22 faces obliquely upward toward the rear. When the board 102 deforms into an arch as shown in FIG. 6(*c*), the rear board mount 22 included in the rear joint 20 rotates relative to the rear base mount 21 in a direction in which the rear end of the rear board mount 22 faces obliquely downward toward the rear.

As described above, the rear joint 20 deforms to follow the deformation of the board 102 simply through pivotal movement of the rear board mount 22, thus preventing the other joints 10, 30, and 40 from being displaced any further. The rear joint 20 thus maintains the entire controllability, and provides a base point for controlling the board 102 with the controller 1. This structure easily improves the connectedness between the board 102 and the controller 1 to increase controllability.

When the board 102 deforms into an inverted arch as shown in FIGS. 5(*b*), 7(*b*), and 8(*b*), the middle portion of the board 102 in the longitudinal direction deforms downward away from the base 5. In response to this deforming board 102, the front-middle stretchable arm 33 in the front-middle joint 30 and the rear-middle arm 43 in the rear-middle joint 40 are inclined actively and protrude downward. This structure allows the board 102 to move away from the base 5, but still allows control over the board 102 through the controller 1.

More specifically, the controller 1 is placed between the binding mounting plates 3, which is highly rigid to receive any load from the snowboarder, and the board 102, which is bendable and deformable. This structure balances between such contradictory properties of the binding mounting plate 3 and the board 102.

In particular, the front-middle joint 30 according to the present embodiment includes the front-middle stretchable arm 33 that stretches with an elastic force applied by the spring 53 (refer to FIG. 7(*b*)). When the board 102 bends into an arch or an inverted arch, the highly stretchable spring 53 included in the front-middle joint 30 stretches to allow appropriate bending of the board 102. When the board 102 bends by a degree greater than a predetermined degree, the elastic force (restoring force) from the spring 53 prevents the board 102 from bending excessively, and rapidly restores the original shape of the board 102. The board 102 can thus deform to closely follow the sliding slope surface. The structure further improves the connectedness between the board 102 and the controller 1, and thus maintains the controllability of the board 102 with the controller 1.

In other words, when the board 102 deforms into an inverted arch, the longitudinal middle portion of the board 102 described above greatly deforms downward away from the base 5. The highly stretchable and elastic front-middle joint 30 located in the longitudinal middle portion of the board 102 works effectively. This structure has the advantages described above.

As described above, the front joint 10, the rear joint 20, the front-middle joint 30, and the rear-middle joint 40 cooperate with one another using the rear joint 20 as a base point to allow the controller 1 to control bending of the board 102.

The above controller 1 according to the present embodiment is the snowboard controller including the base 5 placeable on the upper surface 102*u* of the board for the snowboard 101, the binding mounting plates 3, on each of which the binding 100 is mountable, at a front position and a rear position of the base 5 in the longitudinal direction of the base 5, and a plurality of joints 10, 20, 30, and 40 that join the base 5 to the upper surface 102*u* of the board to allow a predetermined movable range to control bending of the board 102. The joints 10, 20, 30, and 40 include the rear joint 20, which is a direct joint at which the base 5 is directly joined to the board 102 in a rotatable manner, and the front joint 10, the front-middle joint 30, and the rear-middle joint 40, which are indirect joints at which the base 5 is indirectly joined to the board 102 with the joining members (the slide shaft 13, the front-middle stretchable arm 33, and the rear-middle arm 43).

The above structure increases controllability without reducing the flexibility of the snowboard 101.

In the above structure, the base 5 is arranged between the binding mounting plates 3 and the board 102 and is joined to the upper surface 102*u* of the board with the plurality of joints 10, 20, 30, and 40 to allow a predetermined movable range. This structure prevents the flexibility of the board 102 from being reduced by the highly rigid binding mounting plate 3 more effectively than a known structure including the binding mounting plates 3 that are directly mounted on the board 102.

In the above structure, the rear joint 20 included in the plurality of joints 10, 20, 30, and 40 is as the direct joint at which the base 5 is directly joined to the board 102, whereas the other joints 10, 30, and 40 are the indirect joints at which the base 5 is indirectly joined to the board 102 with the joining members 13, 33, and 43. The other indirect joints 10, 30, and 40 are movable within the movable range relative to the rear joint 20. This structure controls the bending of the board 102.

In the structure in which all the joints are direct joints, the joining members included in each of the plurality of joints may move freely in different directions within their corresponding movable ranges. This structure can degrade the controllability of the board 102 through the base 5. Unlike this, the structure according to the present embodiment prevents the loss of controllability, and increases controllability without reducing the flexibility of the snowboard 101.

In the structure according to one aspect of the present invention, the joints may each be arranged on both ends of the base 5 in the longitudinal direction and in the middle of the base 5 in the longitudinal direction. The rear joint 20 arranged at the rear end of the base 5 may be the direct joint.

The above structure controls the board 102 efficiently, and further increases the controllability of the board 102.

In the above structure, more specifically, the joints 10, 20, 30, and 40 are arranged at the front end and the rear end of the base 5 in the longitudinal direction and in the middle of the base 5 in the longitudinal direction. The board 102 can thus be controlled efficiently with fewer joints arranged in the longitudinal direction of the base 5.

The rear joint 20 arranged at the rear portion of the base 5 in the longitudinal direction is the direct joint. The direct joint is used as a base point to enable effective control of the bending of the board 102, and to increase the controllability of the board 102 further.

In the structure according to the above aspect, the front-middle joint 30 may include the front-middle stretchable arm 33 or a stretchable joint member, which stretches in the axial direction of the arm, and the spring 53 or a stretch resistance providing unit, which controls bending of the board 102, using an elastic force in the front-middle stretchable arm 33.

In the above structure, the front-middle joint 30 includes the front-middle stretchable arm 33 including the spring 53. The front-middle stretchable arm 33 absorbs shocks during sliding with the spring 53 to enhance the shock absorption.

The board 102 bending and deforming during sliding receives an elastic force from the spring 53, and thus easily restores its original shape for sliding on subsequent sliding slope surfaces. The board 102 can bend and deform to closely follow rugged sliding slope surfaces, thus providing better controllability.

The structure according to the above aspect may further include the elastic force adjusting nut 55*a* or a stretch-resistance adjusting unit, which adjusts the magnitude of the elastic force in the front-middle stretchable arm 33 provided by the spring 53.

The above structure includes the stretch-resistance adjusting unit that adjusts the magnitude of the stretch resistance in the stretchable joint member in accordance with sliding conditions or the ability and the skill level of each snowboarder (user), and increases the controllability of the board 102 further.

The structure according to the above aspect may further include the pair of control units 2 each including the base 5 and the joints 10, 20, 30, and 40. The pair of control units 2 may be arranged in parallel in the width direction on the upper surface 102*u* of the board.

The above structure includes the pair of control units 2 that are arranged in parallel in the width direction on the upper surface 102*u* of the board, and thus controls the bending of the board 102 at both sides of the board 102 in the width direction using the joints 10, 20, 30, and 40, which allow the predetermined range of movement relative to the base 5. This increases stability and controllability.

The structure according to the above aspect may further include base joining members arranged between the pair of control units 2 in the width direction. The base joining members may join the two bases 5 included in the pair of control units 2 in the width direction. The base joining members may be used as the binding mounting plates 3.

The above structure includes the binding mounting plates 3, which are the base joining members, arranged between the pair of control units 2 in the width direction. The pair of control units 2 each support the weight of the user in a balanced manner through the binding mounting plates 3. The binding mounting plates 3 also join the pair of control units 2. This structure eliminates any additional joining member for joining the pair of control units 2 to each other, and thus reduces the number of components.

A binding mount of the invention corresponds to the binding mounting plates 3 in the present embodiment.

Similarly, a plurality of joints correspond to the front joint 10, the rear joint 20, the front-middle joint 30, and the rear-middle joint 40, indirect joints correspond to the front joint 10, the front-middle joint 30, and the rear-middle joint 40, a direct joint corresponds to the rear joint 20, joining members correspond to the slide shaft 13, the front-middle stretchable arm 33, and the rear-middle arm 43, a stretchable joining member corresponds to the front-middle stretchable arm 33, a stretch-resistance providing unit corresponds to the spring 53, a stretch-resistance adjusting unit corresponds to the elastic force adjusting nut 55*a*, at least one of front and rear ends of the base in the longitudinal direction corresponds to the read end of the base 5, and a torsion control unit 61 (described later) corresponds a torsion control plate 61 or a torsion control beam 71. The invention is not limited to the structures according to the above embodiments.

Figure 9:
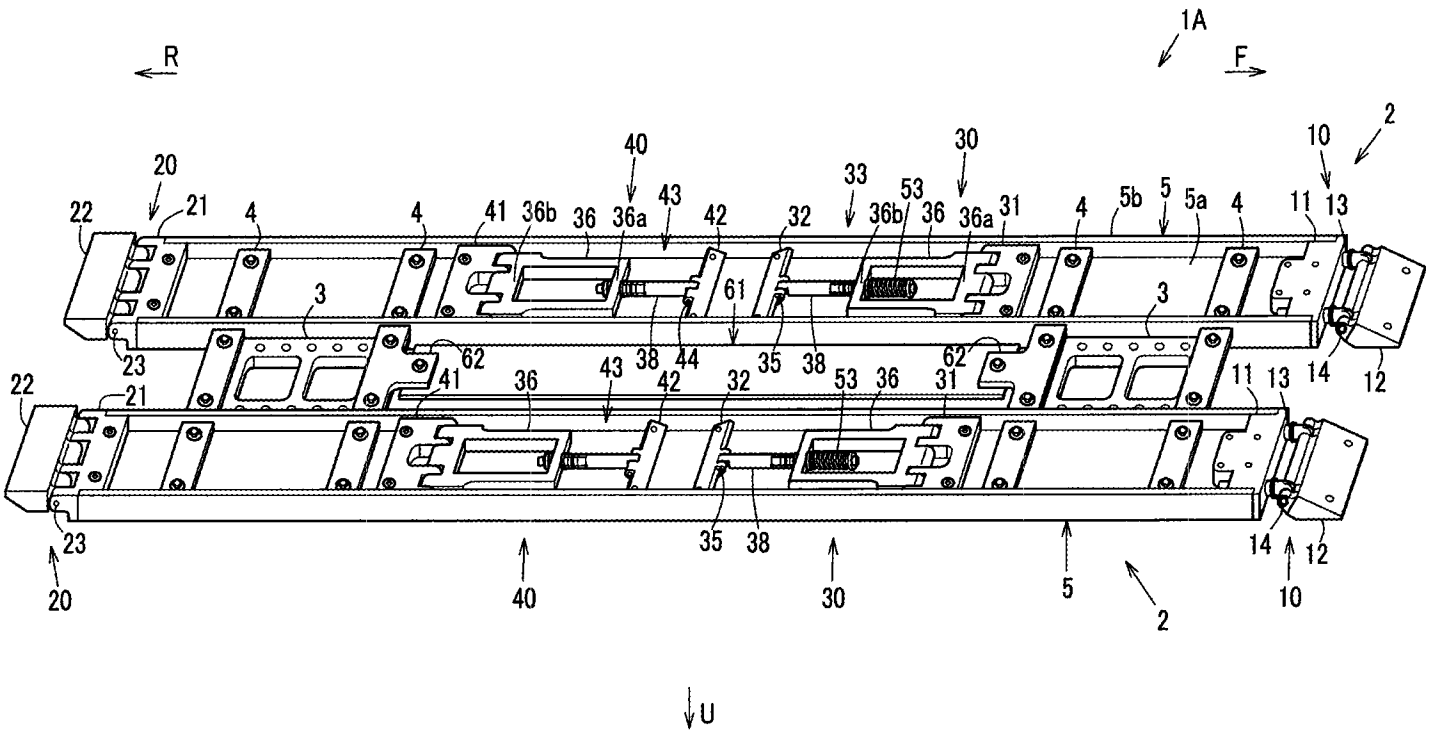
FIG. 9 is a perspective view of a snowboard controller according to another embodiment as viewed from below.
Figure 10:
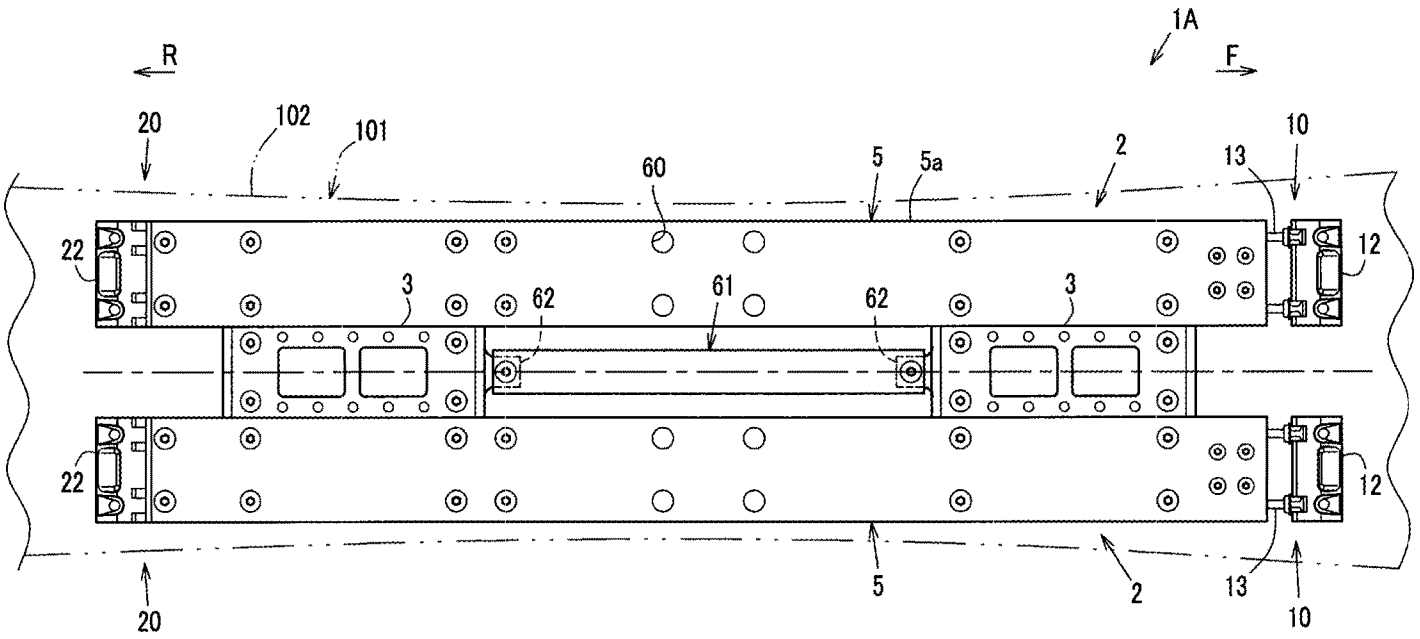
FIG. 10 is a plan view of the snowboard controller according to the other embodiment.

For example, a controller 1A shown in FIGS. 9 and 10 includes a torsion control plate 61, which is a torsion control unit 61 extending in the front and rear direction between the bases 5 included in the pair of control units 2 in the width direction.

More specifically, the torsion control plate 61 is an elongated plate formed from the same carbon fibers as used for the base 5. In a plan view, the torsion control plate 61 is arranged in the longitudinal direction to have its one flat surface facing upward in a space defined by the front and rear binding mounting plates 3 and the control units 2 at both sides in the width direction.

The front end of the torsion control plate 61 is joined and fixed, with a bolt or another connection, to a mounting tab 62 that extends rearward from the joining plate 4 adjacent to the front end. The rear end of the torsion control plate 61 is joined and fixed, with a bolt or another connection, to a mounting tab 62 that extends frontward from the joining plate 4 adjacent to the rear end. The torsion control plate 61 has its central axis in the width direction aligned with the central axis of the pair of control units 2 in the width direction. The torsion control plate 61 bridges between the front and rear joining plates 4.

When the controller 1 receives a force that deforms, in directions different from each other about the central axis, one end and the rear end of the controller 1 in the longitudinal direction, or specifically when a torsion force about the central axis is exerted, the torsion control plate 61 maintains the shape before the torsion using its elastic force (restoring force). This structure thus reduces the effect from the torsion in the board 102 through the controller 1 and increases the stability and controllability of the board 102.

The torsion about the axis, which corresponds to the torsion control unit 61 extending in the longitudinal direction, during sliding, can thus also be controlled. This structure enables smooth sliding at turns.

Figure 11:
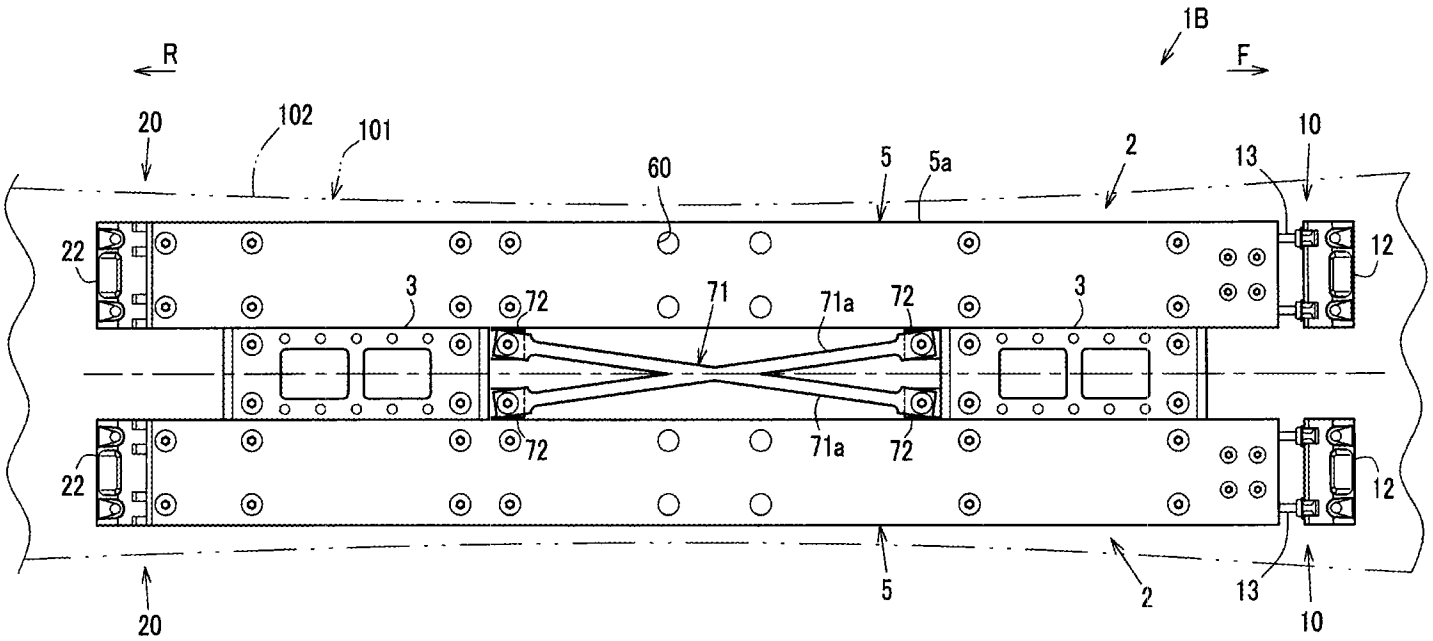
FIG. 11 is a plan view of a snowboard controller according to still another embodiment.

The torsion control unit 61 is not limited to the above torsion control plate 61, but may be a torsion control beam 71 shown in FIG. 11.

The torsion control beam 71 includes two beams 71*a* that cross with each other in a plan view. In the controller 1B, the torsion control beam 71 is arranged diagonally in a space defined by the front and rear binding mounting plates 3 and the control units 2 at both sides in the width direction in a plan view. Each end of the torsion control beam 71 is joined and fixed, with a bolt or another connection, to a corresponding mounting tab 72 at a portion in each joining plate 4 adjacent to the corresponding end of the torsion control beam 71.

The controller 1B including the torsion control beam 71 with the above structure produces the same advantageous effects as the control unit 61 described above.

Figure 12:
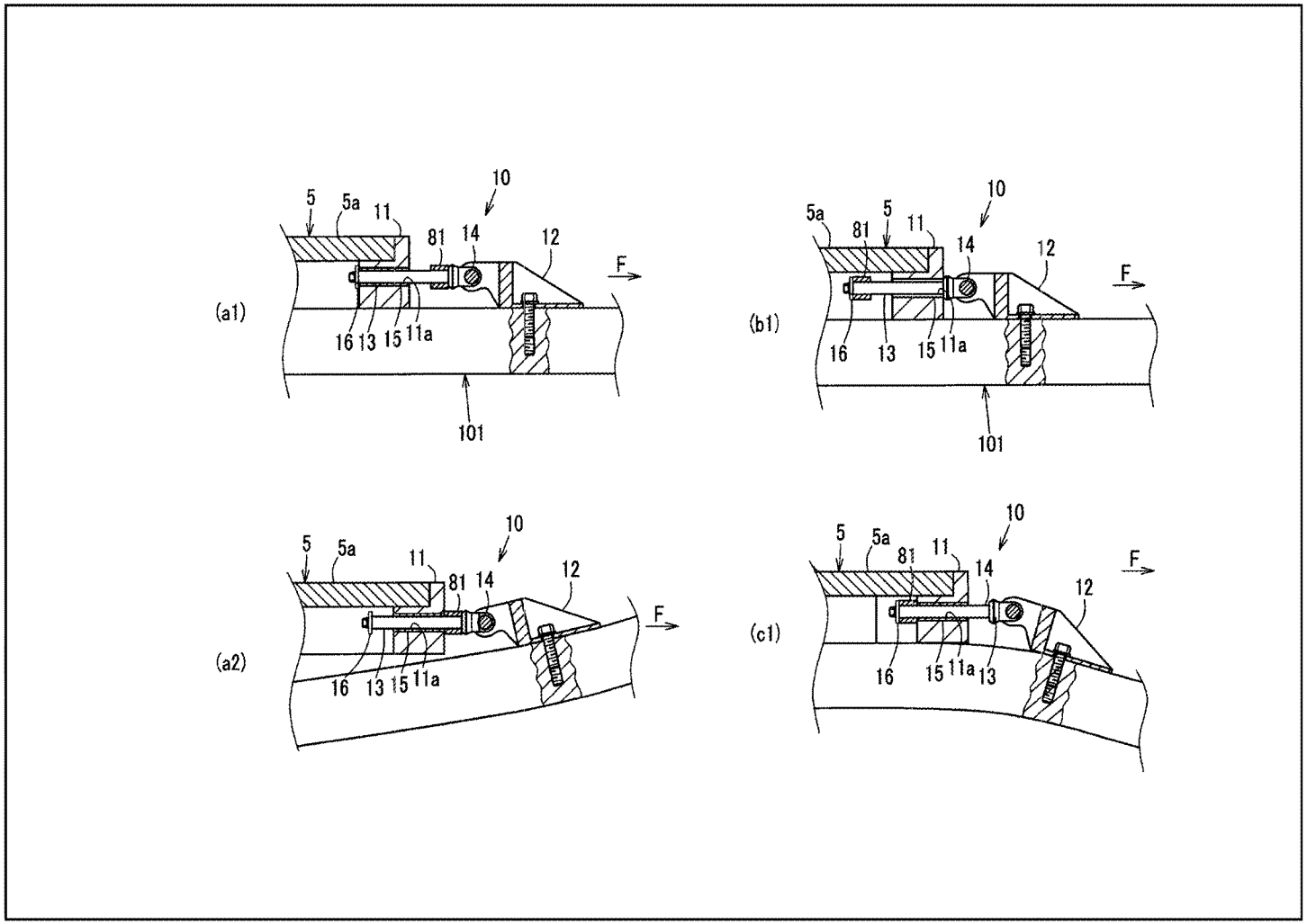
FIG. 12 is a diagram describing the snowboard controller according to the other embodiment.

In another embodiment, as shown in FIG. 12(*a*1, *b*1), the front joint 10 includes a slide length adjustment unit 81 that adjusts the slide length of the front board mount 12 relative to the front base mount 11.

More specifically, the slide length adjustment unit may be a C-ring slide length adjusting block 81 (hereafter, a block 81), which is mounted on the periphery of the slide shaft 37 in a removable manner.

The block 81 may be mounted more frontward than the front base mount 11 in the axial direction of the slide shaft 37 as shown in FIG. 12(*a*1). When the board 102 bends into an inverted arch, as shown in FIG. 12(*a*2), the front board mount 12 retracts rearward and the block 81 comes in contact with the front base mount 11. The block 81 thus regulates the front board mount 12 to prevent the mount from retracting rearward further.

The block 81 mounted more frontward than the front base mount 11 in the axial direction of the slide shaft 37 as shown in FIG. 12(*a*1) can prevent the front joint 10 from following the deformation of the board 102, which occurs when the board 102 bends into an inverted arch. This consequently reduces the bending of the front portion of the board 102.

The block 81 may be mounted more rearward than the front base mount 11 in the axial direction of the slide shaft 37 as shown in FIG. 12(*b*1). When the board 102 bends into an arch, as shown in FIG. 12 (*c*1), the front board mount 12 protrudes frontward and the block 81 comes in contact with the front base mount 11. The block 81 thus regulates the front board mount 12 to prevent the mount from protruding frontward further.

The block 81 mounted more rearward than the front base mount 11 in the axial direction of the slide shaft 37 as shown in FIG. 12(*b*1) can prevent the front joint 10 from following the deformation of the board 102, which occurs when the board 102 bends into an arch. This consequently reduces the bending of the front portion of the board 102.

As described above, the front joint 10 can adjust the slide amount of the slide shaft 37 by including the block 81 or by changing the mounting position of the block 81 relative to the slide shaft 37 or the thickness of the block 81 in the axial direction of the slide shaft 13. The front joint 10 can thus adjust the degree of bending of the front portion of the board 102.

Figure 13:
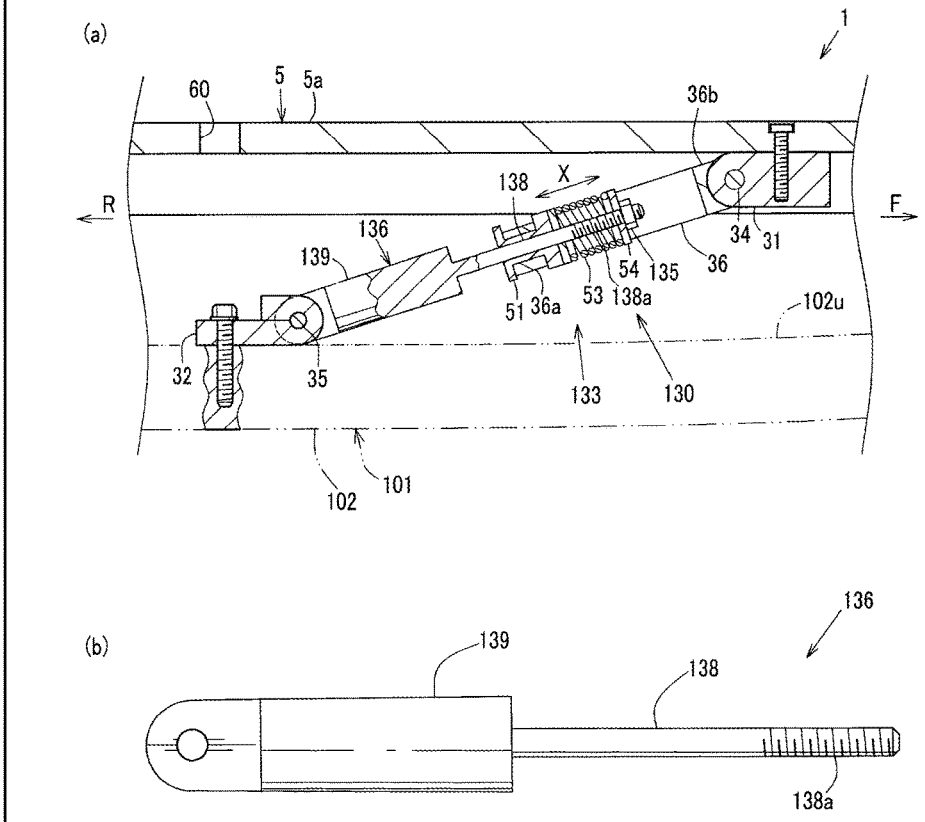
FIG. 13 is a diagram describing a front-middle joint in another embodiment.

Although the above front-middle joint 30 including the front-middle stretchable arm 33 can adjust the stretch amount of the spring 53 using the double nut 55 (55*a*, 55*b*) included in the front-middle stretchable arm 33 (refer to FIG. 7(*a, b*)), the stretchable joint member according to the embodiment of the present invention is not limited to the above structure, and may have another structure according to other embodiments, including the structure shown in FIG. 13(*a, b*).

FIG. 13(*a*), which corresponds to FIG. 7(*b*), is a diagram describing a front-middle stretchable arm 133, or the stretchable joining member, included in a front-middle joint 130 according to another embodiment. FIG. 13(*b*) is a front view of a front-middle stretchable arm body 136 described below that is included in the front-middle stretchable arm 133.

The front-middle stretchable arm 133 in the present embodiment includes the front-middle stretchable arm body 136 and an elastic force adjusting nut 135. As shown in FIG. 13(*a, b*), the front-middle stretchable arm body 136 is a stepped shaft, and includes a large-diameter arm segment 139 near the board 102 in its axial direction, and includes a small-diameter arm segment 138 having a smaller diameter than the larger-diameter arm segment 139 near the base 5. The large-diameter arm segment 139 and the small-diameter arm segment 138 are formed as one piece or formed in an integral manner.

More specifically, the large-diameter arm segment 139 and the small-diameter arm segment 138 are formed as a single member, or are integrated into one piece by, for example, fitting the small-diameter arm segment 138 into the large-diameter arm segment 139.

Unlike the slide shaft 37 in the above embodiment (refer to FIG. 7(*b*)), the small-diameter arm segment 138 eliminates the head 37*b*, but includes external threads 138*a* on its end nearer the base 5 in the axial direction as shown in FIG. 13(*a, b*). The small-diameter arm segment 138 includes the above elastic force adjusting nut 135, which is to be screwed on the external threads 138*a* (refer to FIG. 13(*a*)).

The elastic force adjusting nut 135 is rotated relative to the small-diameter arm segment 138. This rotation adjusts the length of the spring 53, which is arranged between the pressing plate 54 and the guide bush 51, with the pressing plate 54 in accordance with the direction and the degree of the rotation, or specifically adjusts the stretch amount (elastic force) of the spring 53.

The front-middle stretchable arm 133 in the present embodiment, which has the large-diameter arm segment 139 and the small-diameter arm segment 138 integrated into one piece, can thus adjust the elastic force from the spring 53 without the arm length adjustment nut 52 or the double nut 55 (55*a*, 55*b*), unlike the front-middle stretchable arm 33 shown in FIG. 7(*a, b*). The front-middle stretchable arm 133 in the present embodiment includes fewer components, and thus the entire structure becomes simple and compact.

REFERENCE SIGNS LIST

1, 1A, 1B snowboard controller
2 control unit
3 binding mounting plate
5 base
10 front joint
13 slide shaft
20 rear joint
30, 130 front-middle joint
33, 133 front-middle stretchable arm
40 rear-middle joint
43 rear-middle arm
53 spring
55*a*, 135 elastic force adjusting nut
61 torsion control plate
71 torsion control beam
136 front-middle stretchable arm body

The invention claimed is:

1. A snowboard controller, comprising:

a base placeable on an upper surface of a board for a snowboard;

a front binding mount and a rear binding mount on each of which a binding is mountable, the front binding mount and the rear binding mount being at a front position and a rear position of the base in a longitudinal direction of the base; and a plurality of joints configured to join the base to the upper surface of the board to allow a predetermined movable range to control bending of the board, wherein the plurality of joints include a direct joint at which the base is directly joinable to the board in a rotatable manner, and an indirect joint at which the base is indirectly joinable to the board with a joining member, the plurality of joints include one joint being the direct joint, and other joints each being the indirect joint that controls bending of the board using the direct joint as a base point, the plurality of joints are arranged on at least one of a front end and a rear end of the base in the longitudinal direction and on a middle portion of the base in the longitudinal direction, and the joint arranged on the at least one of the front end and the rear end of the base is the direct joint.

2. A snowboard controller, comprising:

a base placeable on an upper surface of a board for a snowboard;

a front binding mount and a rear binding mount on each of which a binding is mountable, the front binding mount and the rear binding mount being at a front position and a rear position of the base in a longitudinal direction of the base; and a plurality of joints configured to join the base to the upper surface of the board to allow a predetermined movable range to control bending of the board, wherein the plurality of joints include a direct joint at which the base is directly joinable to the board in a rotatable manner, and at least one indirect joint at which the base is indirectly joinable to the board with a joining member, the plurality of joints include one joint being the direct joint, and other joints each being the indirect joint that controls bending of the board using the direct joint as a base point, at least one of the indirect joints includes a stretchable joining member that is stretchable in a longitudinal direction of the indirect joints, a stretch-resistance providing unit configured to provide stretch resistance in the stretchable joining member to control bending of the board, and a stretch-resistance adjusting unit configured to adjust a magnitude of the stretch resistance provided by the stretch-resistance providing unit in the stretchable joining member.

3. The snowboard controller according to claim 1, further comprising:

a pair of control units each including the base and the plurality of joints, the pair of control units being placeable on the upper surface of the board in parallel in a width direction.

4. A snowboard controller, comprising:

a base placeable on an upper surface of a board for a snowboard;

a front binding mount and a rear binding mount on each of which a binding is mountable, the front binding mount and the rear binding mount being at a front position and a rear position of the base in a longitudinal direction of the base;

a plurality of joints configured to join the base to the upper surface of the board to allow a predetermined movable range to control bending of the board, the plurality of joints including a direct joint at which the base is directly joinable to the board in a rotatable manner, and an indirect joint at which the base is indirectly joinable to the board with a joining member, the plurality of joints including one joint being the direct joint, and other joints each being the indirect joint that controls bending of the board using the direct joint as a base point; and a pair of control units each including the base and the plurality of joints, the pair of control units being placeable on the upper surface of the board in parallel in a width direction.

5. The snowboard controller according to claim 3, further comprising:

a torsion control unit that extends in the longitudinal direction of the base between the bases included in the pair of control units in a width direction of the bases.

6. The snowboard controller according to claim 3, further comprising:

base joining members arranged between the pair of control units in the width direction, the base joining members joining the bases included in the pair of control units in the width direction, wherein the base joining members are the front binding mount and the rear binding mount arranged at the front position and the rear position in the longitudinal direction of the base.

7. The snowboard controller according to claim 2, further comprising:

a pair of control units each including the base and the plurality of joints, the pair of control units being placeable on the upper surface of the board in parallel in a width direction.

8. The snowboard controller according to claim 4, further comprising:

a torsion control unit that extends in the longitudinal direction of the base between the bases included in the pair of control units in a width direction of the bases.

9. The snowboard controller according to claim 4, further comprising:

base joining members arranged between the pair of control units in the width direction, the base joining members joining the bases included in the pair of control units in the width direction, wherein the base joining members are the front binding mount and the rear binding mount arranged at the front position and the rear position in the longitudinal direction of the base.

10. The snowboard controller according to claim 5, further comprising:

base joining members arranged between the pair of control units in the width direction, the base joining members joining the bases included in the pair of control units in the width direction, wherein the base joining members are the front binding mount and the rear binding mount arranged at the front position and the rear position in the longitudinal direction of the base.

* * * * *